US007156746B2

(12) United States Patent
Scripps

(10) Patent No.: US 7,156,746 B2
(45) Date of Patent: Jan. 2, 2007

(54) APPARATUS AND METHOD FOR CONVEYING A BOWLING PIN IN A PINSETTER PIN SOCK IN A BOWING ALLEY

(76) Inventor: William J. Scripps, P.O. Box 577, Lakeville, MN (US) 55044

( * ) Notice: Subject to any disclaimer, the term of this patent is extended or adjusted under 35 U.S.C. 154(b) by 0 days.

(21) Appl. No.: 11/096,435

(22) Filed: Mar. 31, 2005

(65) Prior Publication Data

US 2006/0223645 A1 Oct. 5, 2006

(51) Int. Cl.
*A63D 5/08* (2006.01)

(52) U.S. Cl. ..... 473/54; 473/73

(58) Field of Classification Search ..... 473/54, 473/73, 94, 95, 96

See application file for complete search history.

(56) References Cited

U.S. PATENT DOCUMENTS 4,410,177 A 10/1983 Richardson
5,152,525 A 10/1992 Brim et al.
5,372,551 A 12/1994 McCarthy et al.
5,759,108 A 6/1998 Heddon
5,853,380 A * 12/1998 Miller ..... 602/27

OTHER PUBLICATIONS

Advanced Performance Parts website, "Genuine Brunswick Parts", "GS Heavy Duty Overflow Sock", www.brunswickbowling.com/uploads/DocumentManager/2145_287_1097236240/section_4.pdf, Sep. 30, 2005.*

"GS-Series Pinsetter Operation & Service Manual", http://www.centermaster.commanualsEnglish47-902728sect01_operations.pdf, (2005).

* cited by examiner

*Primary Examiner*—William M. Pierce
(74) *Attorney, Agent, or Firm*—Charles A. Lemaire; Lemaire Patent Law Firm, P.L.L.C.

(57) ABSTRACT

The present invention provides for an apparatus and method for conveying a bowling pin into a Pin Sock at a bowling alley. This invention stitches a Hardened Inserting into a Pin Sock. The lip of the Hardened Insert extends beyond the end of output exit of the Pin Sock. Moreover, the output exit of the Pin Sock is larger than traditional Pin Socks. The insertion of a Hardening Insert makes the Pin Sock, and in particular the lower end of the Pin Sock more durable against the constant wear and tear caused by bowling pins entering the sock from an Overflow Chute. By reducing this wear and tear, the bowling pins exiting the Pin Sock would cause less damage to the Transport Band where the pins are deposited after exiting the Pin Sock. Additionally, the enlarged output exit reduces the possibility of pin jams as compared to traditional Pin Socks.

20 Claims, 7 Drawing Sheets

APPARATUS AND METHOD FOR CONVEYING A BOWLING PIN IN A PINSETTER PIN SOCK IN A BOWING ALLEY

FIELD OF THE INVENTIONS

This invention relates to bowling equipment, and more particularly to an apparatus and method for delivering bowling pins via Pin Socks to the Transport Bands utilized in pinsetters systems.

BACKGROUND OF THE INVENTION

A pinsetter is a type of apparatus that sets bowling pin into a ten (10) pin configuration as is common in the sport of bowling. Such pinsetters are well known in the art. Pinsetters contain a number of electrical and mechanical subassemblies. One of these subassemblies is known in the art as the Ball Pit, while another of these subassemblies in known in the art as the Distributor. The Ball Pit is a depression or pit located adjacent to the end of a bowling lane. The purpose of the Ball Pit is to handle the initial impact of the bowling pins ("pins") and the bowling ball ("ball") after a ball has been thrown down a bowling lane (i.e., bowled), and to assist in cycling both the pins and ball through the pinsetting machine for the next opportunity to bowl. The Ball Pit is itself composed a number of subassemblies one of which is the Transport Band. The Transport Band is seated at the bottom of the Ball Pit, and consists of a belt mounted on a series of mechanically powered rollers. The purpose of the Transport Band is to assist in the clearing of pins and balls from the Ball Pit by moving the pins to a Pin Elevator, and the ball to a Ball Door. Once the pins are moved to the Pin Elevator, they are cycled to another subassembly of the pinsetter called the Setting Table via the aforementioned Distributor. The Setting Table contains ten openings corresponding to the ten (10) pin configuration of most pin sets. The pins are placed into these openings. Pins that do not find an opening in the Setting Table are routed by the Distributor subassembly to an Overflow Chute and from the Overflow Chute the pins are routed through one or more Overflow Socks ("Pin Socks") and then back unto the Transport Band where they are recycled back though to the Pin Elevator. The Pin Sock serves as an interface between the Distributor subassembly and the Ball Pit subassembly.

Traditional Pin Socks experience a number of problems relating to wear and tear arising from the transporting of pins from the Overflow Chute to the Transport Band. One problem is that existing Pin Socks are made of nylon cloth that is not strong enough to endure the continued stress of pins falling through the Pin Sock. A further problem is that the existing Pin Socks have a slightly curved bottom portion to retard the speed with which pins impact the Transport Band. In traditional Pin Socks, the material used to construct this lower portion is not strong enough to sustain the constant impact of the pins. It is common for the lower portion of the Pin Sock to wear out due to the continuous impact of pins falling through the sock, impacting the lower portion of the sock, and subsequently falling onto the Transport Band. Once the lower portion of the Pin Sock wears out, the speed with which the pins pass through the Transport Band is not retarded, resulting in the pins damaging the Transport Band. The frequent replacement of Transport Bands is a major expense in bowling centers. Another problem is that the structure of the current Pin Socks do always allow for the free flow of pins such that pin jams arising from pins getting stuck in the Pin Sock can occur delaying the game and irritating both bowlers and proprietors of bowling alleys.

One solution to the above described problems is to configure the Pin Sock such that a Hardened Insert can be sewn into the Pin Sock, an insert that due to this configuration can form a J-Shape. To accommodate this insert, the exit opening of the lower portion of the Pin Sock would be increased which would have the additional benefit of lessening or eliminating the aforementioned problem of jams pins. In short, by reconfiguring the Pin Sock to accommodate a Hardened Insert many of the above described problems can be resolved.

SUMMARY OF THE INVENTION

The present invention provides for an apparatus and method for conveying pins from an Overflow Chute to a Transport Band via a Pin Sock. The present invention is an improvement over previous Pin Socks in that it is more durable, and accordingly has a longer period of use. Additionally, it slows the bowling pins that pass through it to such an extent that these pins impact the Transport Band, onto which the pins are conveyed, with less force, thus prolonging the useful life of the Transport Band.

The present invention includes an improved Pin Sock having an open input end adapted to be attached to a lower end of a Overflow Chute, an open output exit, and a resilient pin-slowing inner surface portion configured to hang at a curve that is substantially vertical at its upper end and substantially non-vertical at its lower end, the pin-slowing inner surface portion having a length substantially longer than its width, and a stiffness sufficient to maintain a flattened J-Shape, wherein the lower end of the pin-slowing inner surface portion extends beyond a vertical extension of an opposite side of the sock that hangs substantially vertically from the Overflow Chute.

The Pin Sock further includes an outer fabric sleeve made of ballistic nylon fabric, and the pin-slowing inner surface portion is sewn to an inner surface of the fabric sleeve. In some embodiments, the pin-slowing inner surface portion is made of a plastic-coated fabric that is thicker than the fabric sleeve. In still other embodiments, the pin-slowing inner surface portion is made of a plastic-coated fabric that is more than twice as thick as the fabric sleeve: In still further embodiments, the pin-slowing inner surface portion is made of a material that is thicker than the fabric sleeve. In some embodiments, the Pin Sock has a portion of its surface sleeve made of ballistic nylon fabric, and is sewn to the pin-slowing inner surface portion to form the remainder of the sleeve, and the pin-slowing inner surface portion is made of a plastic-coated fabric that is more than twice as thick as the fabric sleeve. In some embodiments, the Pin Sock is apart of a pinsetting machine that includes: a pin-sweep mechanism configured to move pins from an end of a bowling lane alley to a Ball Pit, an Overflow Chute, wherein the Pin Sock is attached to the Overflow Chute to receive pins that pass through the Overflow Chute, a Pin Elevator configured to move pins from the Ball Pit to a raised position where at least some of the pins drop into the Overflow Chute, after failing to be placed in the Setting Table, wherein the Pin Sock is configured to be attached to the Overflow Chute, and a Transport Band configured to receive pins that drop through the Pin Sock.

In some embodiments, the Pin Sock utilizes a method whereby the Pin Sock receives a bowling pin from a lower exit orifice of an Overflow Chute. Once received the pin is then contained within the pin sleeve. The pin sleeve then acts to slow the pin through the friction of the pin rubbing against a resilient surface within the pin sleeve. At the same time that friction is applied to the pin surface, the direction of the pin is altered from substantially vertical to a direction having a horizontal component through the use of a curve. The bowling pin is ultimately released from the sleeve to position on a Transport Band that is not under a vertical extension of the Overflow Chute's lower exit orifice. The method further includes an outer fabric sleeve made of ballistic nylon fabric, and a pin-slowing inner surface portion is sewn to an inner surface of the outer fabric sleeve. In some embodiments, the method additionally includes constructing the pin-slowing inner surface portion from a plastic-coated fabric that is thicker than the fabric sleeve. In still other embodiments, the pin-slowing inner surface portion is made of a plastic-coated fabric that is more than twice as thick as the fabric sleeve. In some embodiments, the pin-slowing inner surface portion is made of a material that is thicker than the fabric sleeve. Further, in some embodiments, the Pin Sock has a portion of its surface made of ballistic nylon fabric, and is sewn to a pin-slowing inner surface portion to form the remainder of the sleeve, and the pin-slowing inner surface portion is made of a plastic-coated fabric that is more than twice as thick as the fabric sleeve. In some embodiments, the backside of the ballistic nylon or other material forms the inner surface of the sleeve. In some embodiments, the Pin Socket is apart of a method for collecting bowling pins whereby bowling pins are swept from an end of a bowling lane alley to a Ball Pit. Once swept, the pins are elevated pins from the Ball Pit to a raised position. After being raised, some of the pins are released into an Overflow Chute. From the Overflow Chute the pins are funneled into a Pin Sock. A Transport Band then receives these bowling pins from the Pin Sock, and the pins are then transported to a setting mechanism (e.g., a Setting Table) that sets the pins in a ten (10) pin configuration on the end of a lane alley. In some embodiments, this configuration might be other than a ten (10) pin configuration.

In some embodiments, a structure is disclosed that includes a means for receiving a bowling pin from a lower exit orifice of a Overflow Chute, a means for containing the bowling pin, a means for slowing the pin by friction, means for altering the pin's direction along a curve from substantially vertical to a direction having a horizontal component, a means for only releasing the pin from the sleeve to position on a Transport Band that is not under a vertical extension of the Overflow Chute's lower exit orifice. In still other embodiments, the structure includes a means for containing and slowing that includes a sleeve with an outer fabric sleeve made of ballistic nylon fabric, and a pin-slowing inner surface portion is sewn to an inner surface of the outer fabric sleeve. In some embodiments, a single piece of ballistic nylon forms both the inner and outer surface of the Pin Sock. In still further embodiments, the apparatus includes a means for altering the pin's direction that includes the pin-slowing inner surface portion that is J-shaped and is made of a plastic-coated fabric that is thicker than the fabric sleeve. In some embodiments, the pin-slowing inner surface portion is made of a plastic-coated fabric that is more than twice as thick as the fabric sleeve. In still other embodiments, the sleeve has a portion of its surface made of ballistic nylon fabric, and is sewn to a pin-slowing inner surface portion to form the remainder of the sleeve, and the pin-slowing inner surface portion is made of a plastic-coated fabric that is more than twice as thick as the fabric sleeve. In some embodiments, the structure additionally includes a pinsetting machine that with a pin-sweep mechanism configured to move pins from an end of a bowling lane alley to a Ball Pit, an Overflow Chute, wherein the Pin Sock is attached to the Overflow Chute to receive pins that pass through the Overflow Chute, a Pin Elevator configured to move pins from the Ball Pit to a raised position where at least some of the pins drop into the Overflow Chute, wherein the Pin Sock is configured to be attached to the Overflow Chute, a Transport Band configured to receive pins that drop through the Pin Sock, and a pinsetting device (e.g., a Distributor and Setting Table) configured to receive pins from the Transport Band and to set the pins on a surface of the end of the lane alley.

DESCRIPTION OF INVENTION

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

The leading digit(s) of reference numbers appearing in the Figures generally corresponds to the Figure number in which that component is first introduced, such that the same reference number is used throughout to refer to an identical component which appears in multiple Figures. Signals and connections may be referred to by the same reference number or label, and the actual meaning will be clear from its use in the context of the description.

As a threshold matter, the pinsetting apparatus that utilizes the present invention can be made using techniques, such as those described in U.S. Pat. No. 5,759,108 ("the Heddon Patent") incorporated here by reference in its entirety. The Heddon Patent discloses a bowling alley pinsetter that includes a lower Transport Band forming a partial central portion of a pit surface. Hard plastic panels having a slippery top surface flank the central conveyor. The panels are inclined downward from pit kickbacks toward the Transport Band for deflecting balls and pins onto the belt. Pins are delivered to a Pin Elevator by the belt. A ball stop extending transversely across is elevated for passing pins beneath while stopping a bowling ball. A ball sensor detects the ball at the ball stop and initiates a sweeping motion of a ball rake stored proximate one kickback transversely across the pit surface along the ball stop for urging the ball across the pit surface, including the inclined panel, to an opening within one kickback for delivery to an adjacent ball return assembly. The ball rake employs a groove shaft and pawl for converting rotational movement of the shaft to a linear movement of the ball rake. A Ball Door blocking passage through the opening is lifted during the sweeping action for permitting the ball to be passed through the opening. Upon return of the ball rake to its stored position, the Ball Door returns to its blocking position. The central Transport Band is driven by rollers having a groove for receiving a continuous tract extending from an inner surface of the belt contacting the rollers. The track and groove arrangement prevent side-to-side movement of the belt.

Figure 1:
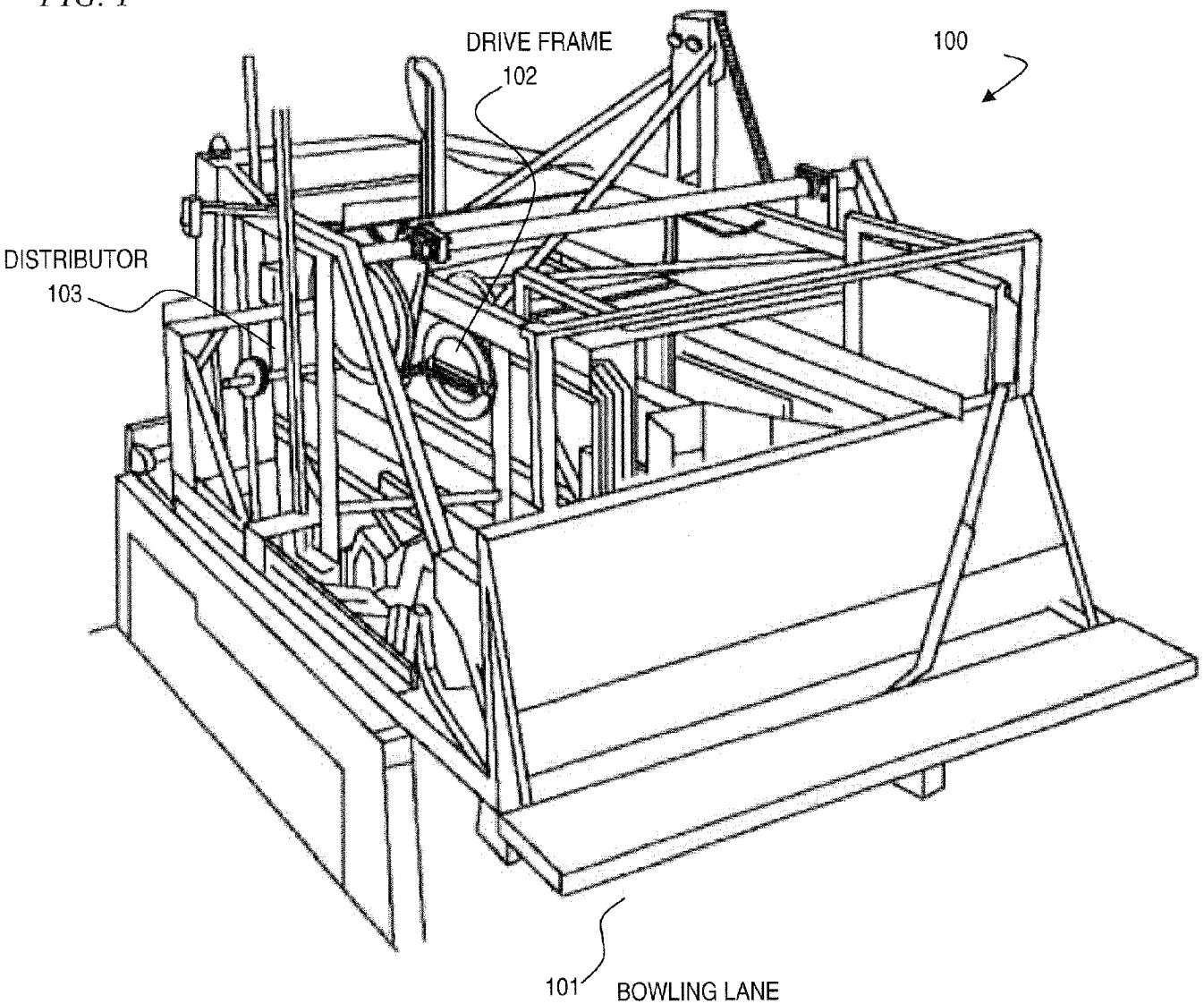
FIG. 1 is a front-perspective view of an apparatus 100 pinsetting machine.

FIG. 1 is a front perspective view of an apparatus 100 pin setting machine. Disclosed are a bowling lane 101, a Drive Frame 102, and a Distributor 103. This apparatus would typically be positioned at the end of a bowling lane adjacent to the area of the bowling lane where the bowling pins would be placed during the course of a game of bowling. The apparatus would then be covered with some type of aesthetically pleasing facade to hide the apparatus and machinery contained therein.

Figure 1A:
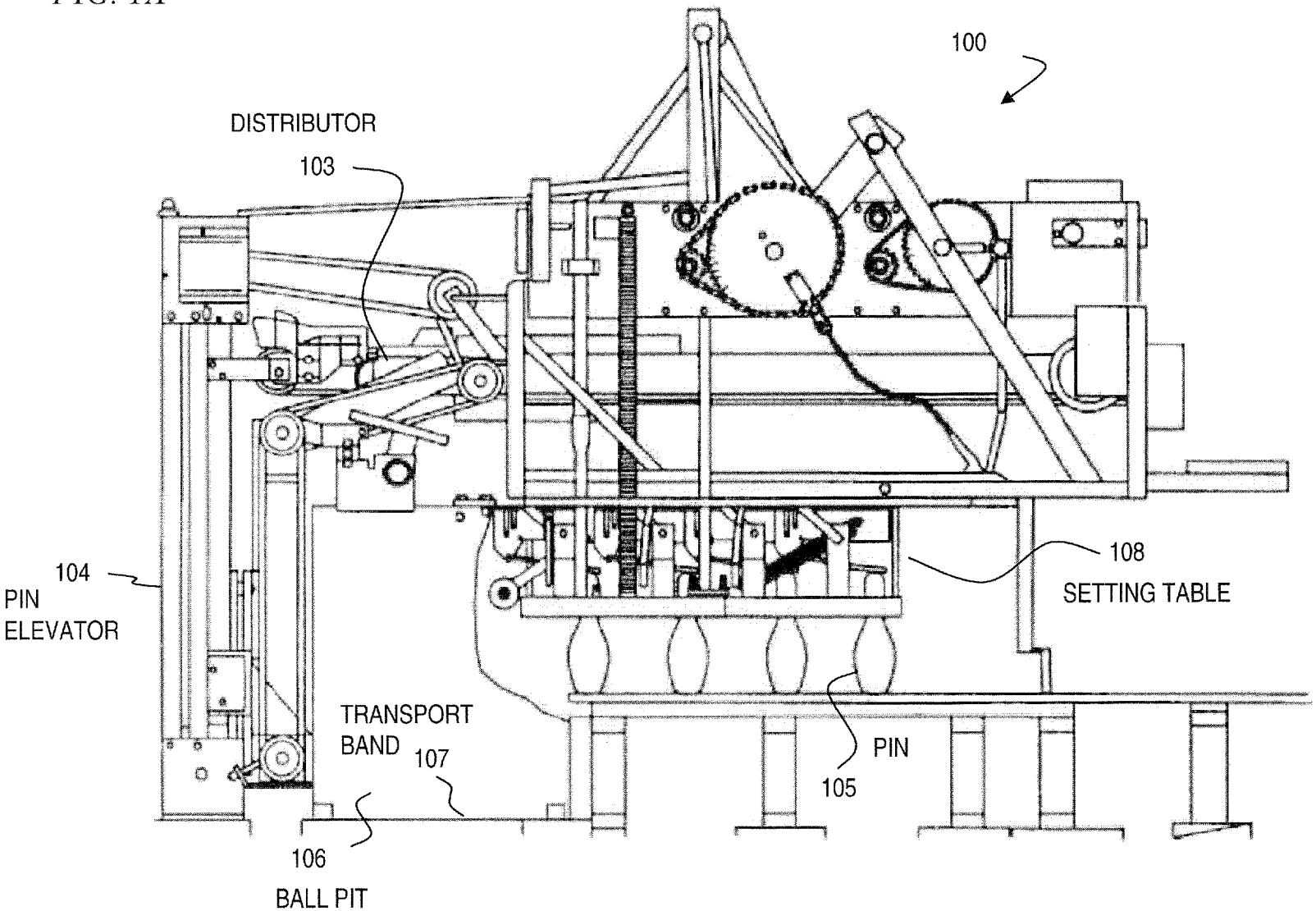
FIG. 1A is a side view of an apparatus 100 pinsetting machine containing a Ball Pit 106, Setting Table 108, Pin Elevator 104, Transport Band 107, a pin 105, and a Distributor 103.

FIG. 1A is a side view of an apparatus 100 pin setting machine containing a Distributor 103, Pin Elevator 104, a pin 105, Ball Pit 106, Transport Band 107, and a Setting Table 108. The functionality of these various subassemblies has been described above.

Some conventional pinsetters, for example Brunswick GS-style™ pinsetters, a type known in the art, include a steel Overflow Chute that collects pins that fail to be placed in the Setting Table 108. Upon being collected in the Over Flow Chute, the pins drop from the lower exit port of the Overflow Chute, and are confined by a Pin Sock, from which the pins drop onto a Transport Band 107. Once on the Transport Band 107, the pins are recycled through the apparatus 100 pinsetter.

Figure 2:
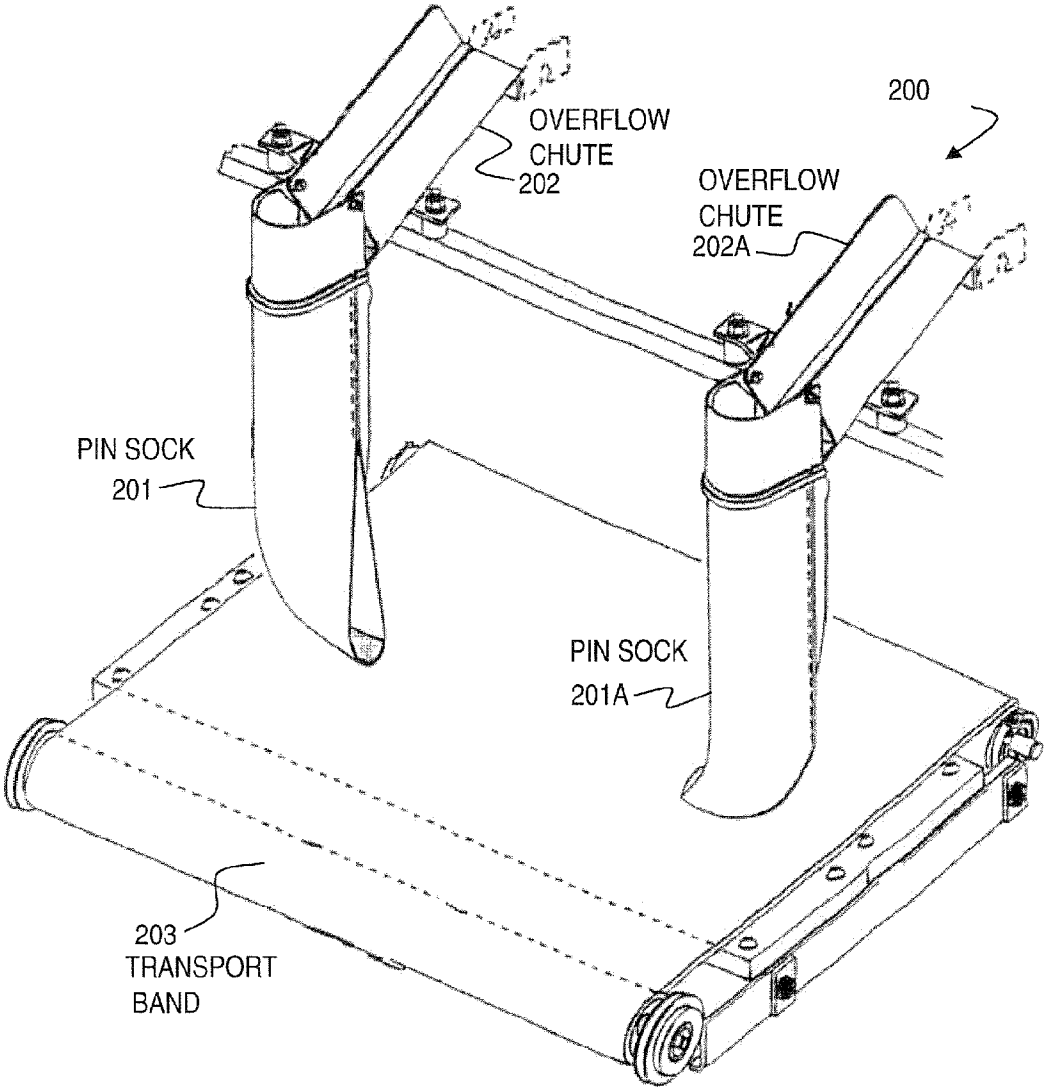
FIG. 2 is perspective view of an apparatus 200 illustration of a pair of Pin Socks 201/201A, operatively connected to an Overflow Chute 202/202A. Positioned below the exit of the Pin Socks 201/201A is a Transport Band 203.

FIG. 2 is perspective view of an apparatus 200 illustration of a pair of prior-art Pin Socks 201/201A, operatively connected via adjustable metal bands to an Overflow Chute 202/202A. Positioned below the exit of the Pin Socks 201/201A is a Transport Band 203. When in use, pins not placed into the Setting Table 108 (i.e., over flow pins) would travel down the Overflow Chutes 202/202A and be captured in the Pin Socks 201/201A. The pins would then exit from the Pin Socks 201/201A via the output exit. Once exiting the Pin Socks 201/201A, the pins would land on the Transport Band 203, where they would be routed back up the Pin Elevator 104 to be potentially placed into the Setting Table 108.

The present invention provides for an apparatus and method for conveying bowling pins via a Pin Sock to a Transport Band 203 of a pinsetting system in a bowling alley. The Pin Socks are used as an apparatus and method of conveyance of bowling pins from a collector apparatus (e.g., the Overflow Chute 202/202A) to the Transport Band 203 that ultimately assists in delivering the pins to the Setting Table 108 that reset the bowling pins into their ten (10) pin configuration. The present invention is an improvement over previous Pin Socks in that it is more durable, and accordingly has a longer period of use. Additionally, it slows the velocity of the bowling pins that pass through it to such an extent that these pins impact the Transport Band 203, onto which the pins are conveyed with less force, thus prolonging the useful life of the Transport Band 203. It is common for pinsetters using traditional Pin Socks to require a replacement Transport Band 203 after as little as eighteen (18) months of use.

In some embodiments, the above described problems relating to Pin Sock wear and tear are solved through the a use of a Hardened Insert sewn into the Pin Sock, and by increasing the size of the exit opening located on the lower portion of the sock. In one embodiment, the Hardened Insert is a piece of poly vinyl chloride ("PVC") material which is approximately ⅛ inch (0.32 cm) thick, 34 inches (86.36 cm) long, and 6 inches (15.24 cm) wide. In some embodiments, other plastic materials and dimensions could be used. In still other embodiments, common household carpet could be used in lieu of the above described PVC material. In some embodiments, the Hardened Insert manifests a J-Shape due to the configuration of Pin Sock and the insertion and stitching of the Hardened Insert into the Pin Sock. In still other embodiments, the Hardened Insert is itself molded into a J-Shape. In some embodiments, the Pin Sock is typically widened and double-stitched to accommodate this Hardened Insert. In some embodiments, the Pin Sock is configured in a curved such that pins exit the output end of the Pin Sock at approximately a 130 degree angle. In some embodiments, the angle formed by the output end is some other angle, the effectiveness of which in addressing the aforementioned problems can be determined through empirical testing and/or modeling. By exiting at an angle, a pin will impact the Transport Band 203 with less force. Specifically, by using the current invention a pin falls in a more horizontal, direction with less velocity as it lands on the Transport Band 203, extending the life of the Transport Band 203. Moreover, a Pin Sock possessing a Hardened Insert lasts much longer than other Pin Socks used in the art. Additionally, in some embodiments, the six (6) inch (15.24 cm) width of the Hardened Insert requires a wider output exit at the bottom of the Pin Sock, thus reducing and in some cases eliminating the pin jams.

Figure 3B:
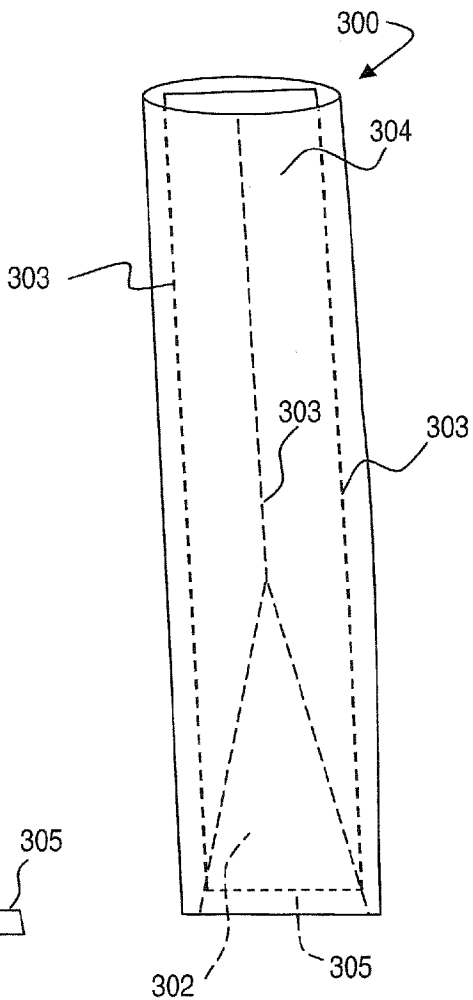
FIG. 3B is a back view of an apparatus 300 with stitched seam 303.
Figure 3A:
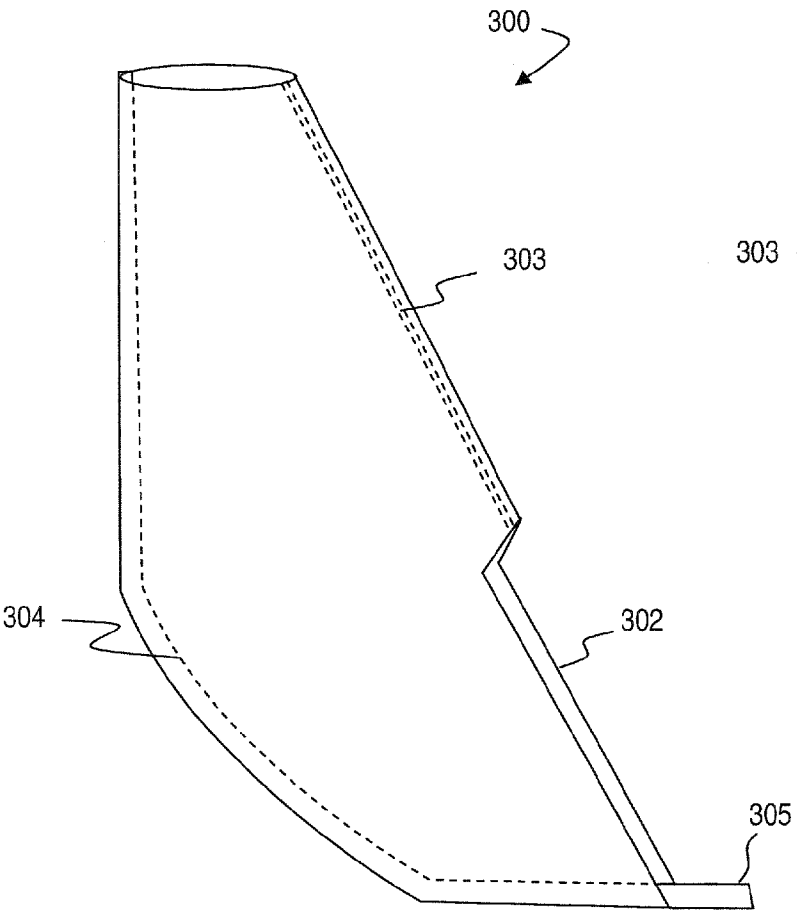
FIG. 3A is a side view of an apparatus 300 with an open output end 302, stitched seam 303, and a Hardened Insert 304.
Figure 3:
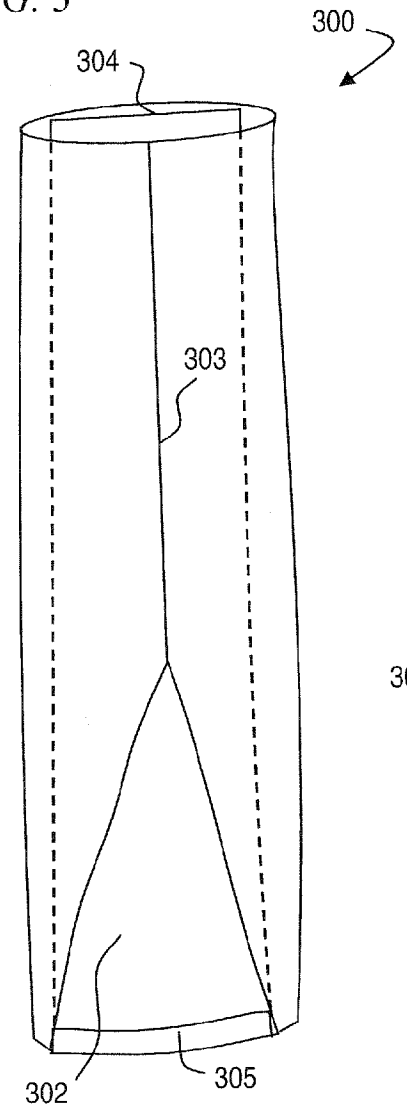
FIG. 3 is a front view of an apparatus 300, with an open output end 302, stitched seam 303, and a Hardened Insert 304.

FIG. 3 is a front view of an apparatus 300 (not to scale) with an open output exit 302, stitched seam 303, a Hardened Insert 304, and Hardened insert lip 305. In some embodiments, the Pin Sock is approximately 30 inches (76.2 cm) long. In some embodiments, the open output exit 302 is 16 inches (40.64 cm) in length. The apparatus 300 is depicted as if it were mounted upon the Overflow Chute 202 or 202A.

FIG. 3A is a side view of an apparatus 300 (not to scale) with an open output exit 302, stitched seam 303, and a Hardened Insert 304. The lip 305 of the Hardened Insert 304 extends approximately 2.5 inches (6.35 cm) beyond the open output exit 302. In some embodiments, the apparatus is 11.5 inches (29.21 cm) from the front edge to the back edge, and appears configured in a J-Shape. The apparatus 300 is depicted as if it were mounted upon the Overflow Chute 202 or 202A.

FIG. 3B is a back view of an apparatus 300 (not to scale) with stitched seams 303 used to operative couple the four (4) components that make up this apparatus. The apparatus 300 is depicted as if it were mounted upon the Overflow Chute 202 or 202A.

Figure 3C:
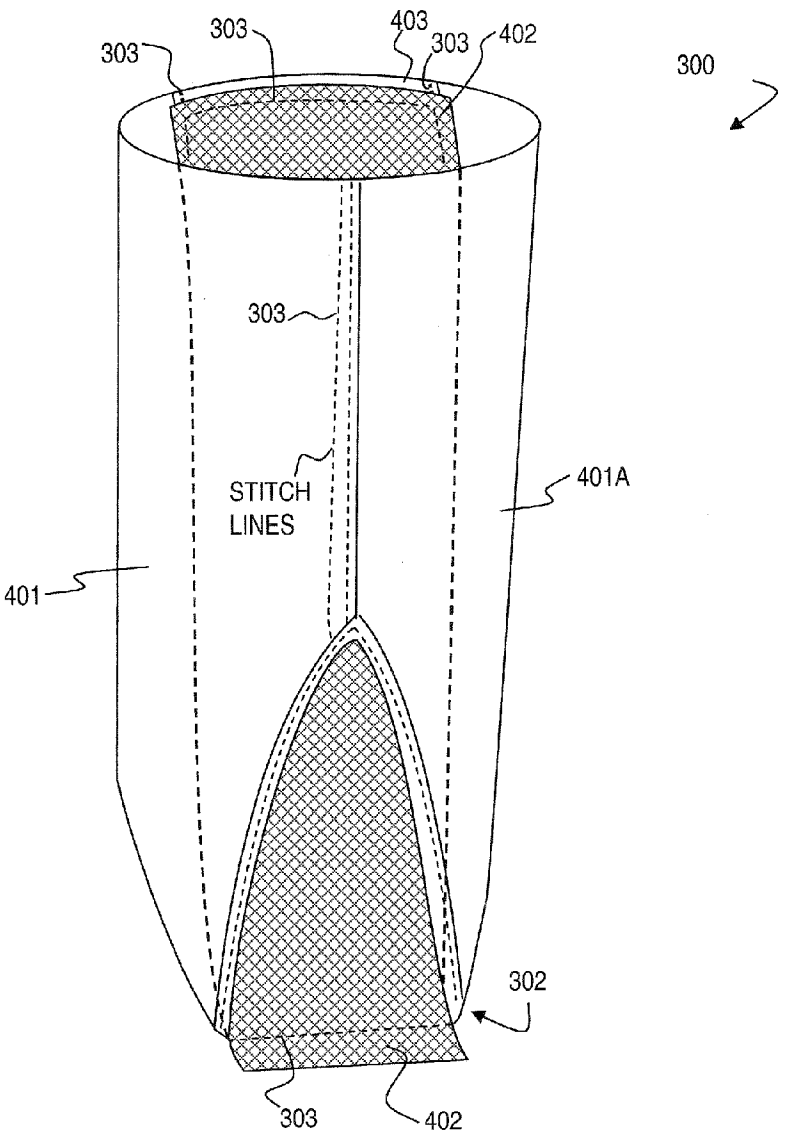
FIG. 3C is as top view of an apparatus 300 with an open input end 301, an open output end 302, stitched seam 303, and a Hardened Insert 304.

FIG. 3C is as top view of an apparatus 300 (not to scale) with a Pin Receiving Opening 301, an open output exit 302, stitched seams 303, and a Hardened Insert 304. In some embodiments, the Pin Receiving Opening 301 is approximately 9 inches (22.86 cm) in diameter. Additionally, disclosed are components 401/401A, 402 and 403 that described below. The apparatus 300 is depicted as if it were mounted upon the Overflow Chute 202 or 202A.

In some embodiments, there are four (4) components that make up the present invention. Specifically, there are two semi-triangular pieces (i.e., a left and right piece) that make up the side walls of the Pin Sock. In some embodiments, each semi-triangular piece is approximately 31 inches (78.74 cm) long, and twelve inches (30.48 cm) wide, with the length and width of the semi-triangular pieces forming a right angle. In some embodiments, a third component of the present invention is a rectangular center strip that is approximately 36 inches long (91.44 cm) and 6 inches (15.24 cm) wide. In some embodiments, a fourth component of the present invention is a rectangular Hardened Insert. This Hardened Insert is approximately 39 inches (99.06 cm) long and 6 inches (15.24 cm) wide. In some embodiments, the dimensions of each of these four (4) component pieces may be altered to be more efficient at solving the above described problems. These alterations could be based upon empirical testing or modeling.

In some embodiments, these four (4) components are stitched together in the following manner. The Hardened Insert is stitched to the center strip such that approximately 2.5 inches (6.35 cm) of the Hardened Insert protrudes from an end of the center strip. The left and right semi-triangular pieces are then single stitched onto the center strip along the hypotenuses of these semi-triangular pieces (i.e., the side opposite to the angle formed by the length and width sides). Next, a single 2 inch (5.08 cm) incision is made in the middle of the length side of each semi-triangular piece to form an upper and lower section of the length side of the semi-triangular pieces. Then, the upper sections are double stitched together to form the input opening into which will fit the lower exit port of the Overflow Chute 202/202A, while the lower sections are pulled back and double stitched to each respective semi-triangular piece to form an open output exit 302.

Figure 4:
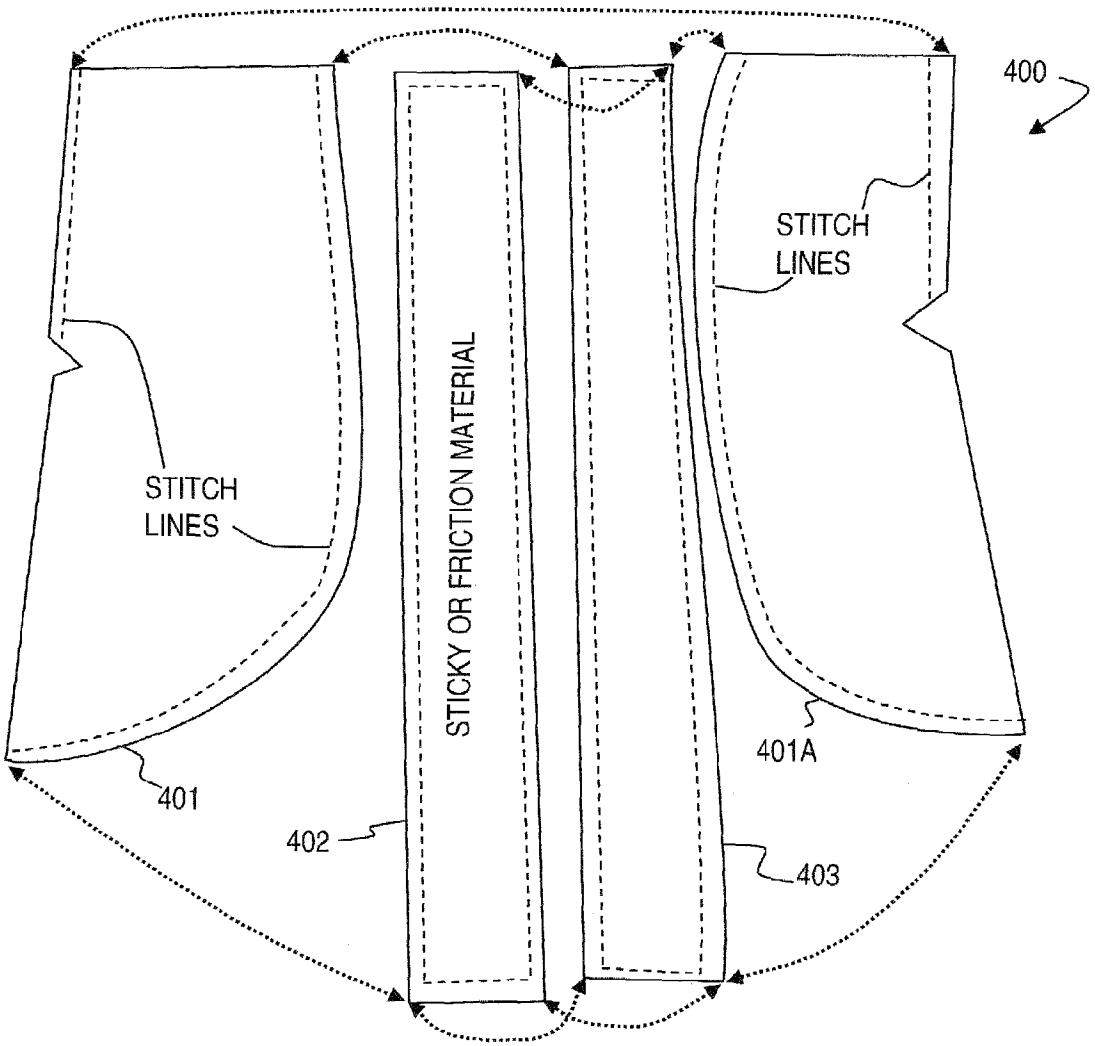
FIG. 4 is a schematic 400 of the four components (401, 401A, 402, 403) that make up the Pin Sock.

FIG. 4 is a schematic 400 of the four (4) components that make up the Pin Sock. Depicted are a left semi-triangular piece 401 and a right semi-triangular piece 401A, a rectangular Hardened Insert 402, and a rectangular center strip 403. In some embodiments, these pieces are operatively connected to form a Pin Sock.

Figure 5:
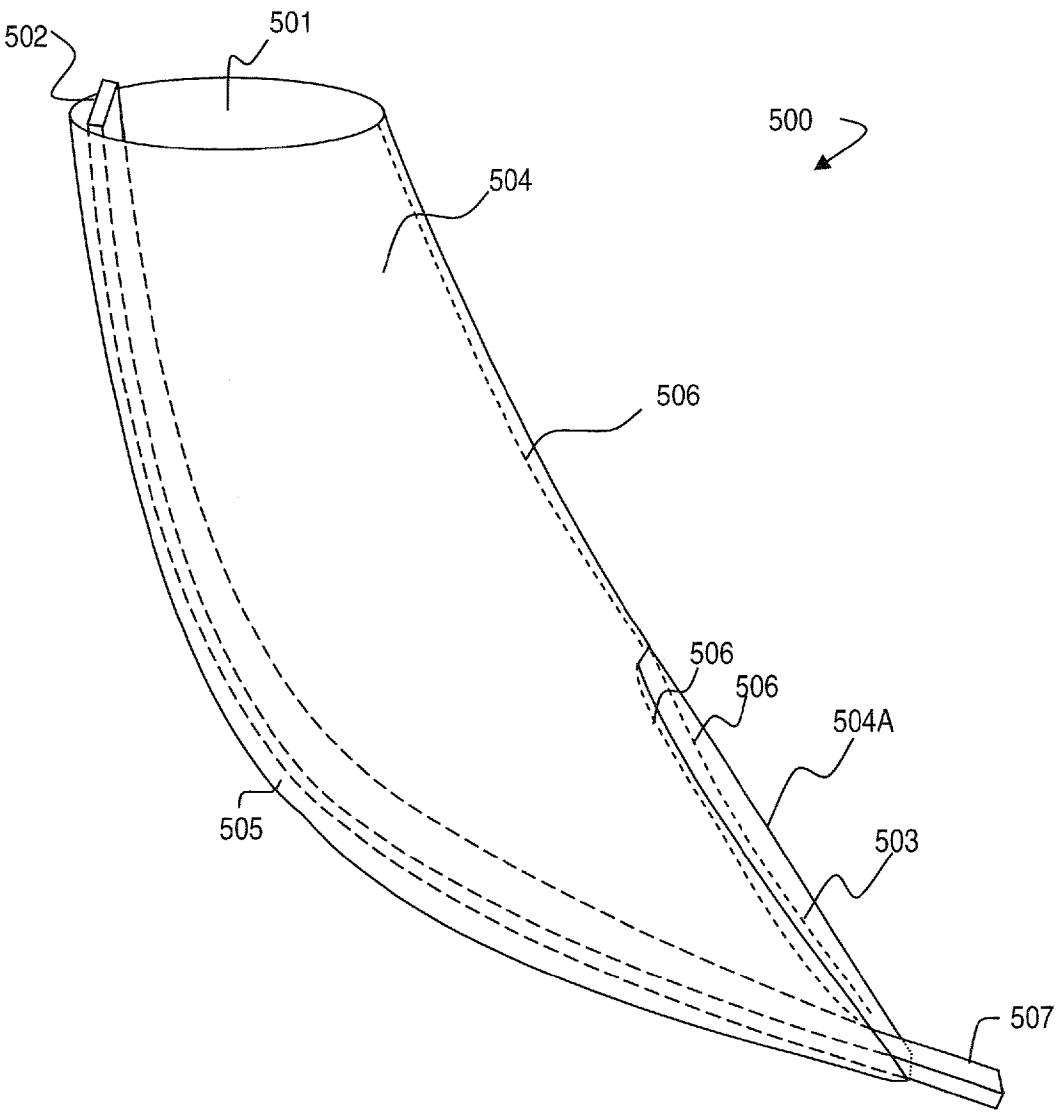
FIG. 5 is an illustration depicting the structure of the apparatus 500.

FIG. 5 is an illustration depicting the structure of the apparatus 500 (not to scale). In some embodiments, a Pin Receiving Opening 501 is formed from two semi-triangular pieces 504/504A, and a rectangular center strip 505 that are stitched together via stitched seams 506. These semi-triangular pieces make up a left and right side of the apparatus 500. Additionally depicted in an Exit Opening 503. Inserted and stitched into the apparatus 500 is a Hardened Insert 502, with an insert lip 507 extending from the Exit Opening 503. This Hardened Insert takes on a substantially J-Shape due to the configuration of the apparatus 500. In some embodiments, however, this Hardened Insert 502 may be molded into a J-Shape thus giving the apparatus 500 a J-Shape as opposed to being configured into such a shape.

The present invention includes an improved bowling Pin Sock having an open input end adapted to be attached to a lower end of a Overflow Chute, an open output exit, and a resilient pin-slowing inner surface portion configured to hang at a curve that is substantially vertical at its upper end and substantially non-vertical at its lower end, the pin-slowing inner surface portion having a length substantially longer than its width, and a stiffness sufficient to maintain a flattened J-Shape, wherein the lower end of the pin-slowing inner surface portion extends beyond a vertical extension of an opposite side of the sock that hangs substantially vertically from the Overflow Chute.

The Pin Sock further includes an outer fabric sleeve made of ballistic nylon fabric, and the pin-slowing inner surface portion is sewn to an inner surface of the fabric sleeve. In some embodiments, the pin-slowing inner surface portion is made of a plastic-coated fabric that is thicker than the fabric sleeve. In still other embodiments, the pin-slowing inner surface portion is made of a plastic-coated fabric that is more than twice as thick as the fabric sleeve. In still further embodiments, the pin-slowing inner surface portion is made of a material that is thicker than the fabric sleeve. In some embodiments, the Pin Sock has a portion of its surface sleeve made of ballistic nylon fabric, and is sewn to the pin-slowing inner surface portion to form the remainder of the sleeve, and the pin-slowing inner surface portion is made of a plastic-coated fabric that is more than twice as thick as the fabric sleeve. In some embodiments, the Pin Sock is apart of a pinsetting machine that includes: a pin-sweep mechanism configured to move pins from an end of a bowling lane alley to a Ball Pit, an Overflow Chute, wherein the Pin Sock is attached to the Overflow Chute to receive pins that pass through the Overflow Chute, a Pin Elevator configured to move pins from the Ball Pit to a raised position where at least some of the pins drop into the Overflow Chute, wherein the Pin Sock is configured to be attached to the Overflow Chute, a Transport Band or Transport Band configured to receive pins that drop through the Pin Sock, and a pinsetting device configured to receive pins from the Transport Band and to set the pins on a surface of the end of the lane alley.

In some embodiments, the Pin Sock utilizes a method whereby the Pin Sock receives a bowling pin from a lower exit orifice of an Overflow Chute. Once received the pin is then contained within the pin sleeve. The pin sleeve then acts to slow the pin through the friction of the pin rubbing against a resilient surface within the pin sleeve. At the same time that friction is applied to the pin surface, the direction of the pin is altered from substantially vertical to a direction having a horizontal component through the use of a curve. The bowling pin is ultimately released from the sleeve to position on a Transport Band that is not under a vertical extension of the Overflow Chute's lower exit orifice. The method further includes an outer fabric sleeve made of ballistic nylon fabric, and a pin-slowing inner surface portion is sewn to an inner surface of the outer fabric sleeve. In some embodiments, the method additionally includes constructing the pin-slowing inner surface portion from a plastic-coated fabric that is thicker than the fabric sleeve. In still other embodiments, the pin-slowing inner surface portion is made of a plastic-coated fabric that is more than twice as thick as the fabric sleeve. In some embodiments, the pin-slowing inner surface portion is made of a material that is thicker than the fabric sleeve. Further, in some embodiments, the Pin Sock has a portion of its surface made of ballistic nylon fabric, and is sewn to a pin-slowing inner surface portion to form the remainder of the sleeve, and the pin-slowing inner surface portion is made of a plastic-coated fabric that is more than twice as thick as the fabric sleeve. In some embodiments, the Pin Socket is apart of a method for collecting bowling pins whereby bowling pins are swept from an end of a bowling lane alley to a Ball Pit. Once swept, the pins are elevated pins from the Ball Pit to a raised position. After being raised, some of the pins are released into an Overflow Chute. From the Overflow Chute the pins are funneled into the pin sleeve. A Transport Band then receives these bowling pins from the pin sleeve, and the pine are then transported to a setting mechanism that sets the pins in a ten (10) pin configuration on the end of a lane alley. In some embodiments, this configuration might be other than a ten (10) pin configuration.

In some embodiments, a structure is disclosed that includes a means for receiving a bowling pin from a lower exit orifice of an Overflow Chute, a means for containing the bowling pin, a means for slowing the pin by friction, means for altering the pin's direction along a curve from substantially vertical to a direction having a horizontal component, a means for only releasing the pin from the sleeve to position on a Transport Band that is not under a vertical extension of the Overflow Chute's lower exit orifice. In still other embodiments, the structure includes a means for containing and slowing that includes a sleeve with an outer fabric sleeve made of ballistic nylon fabric, and a pin-slowing inner surface portion is sewn to an inner surface of the outer fabric sleeve. In still further embodiments, the apparatus includes a means for altering the pin's direction that includes the pin-slowing inner surface portion that is J-shaped and is made of a plastic-coated fabric that is thicker than the fabric sleeve. In some embodiments, the pin-slowing inner surface portion is made of a plastic-coated fabric that is more than twice as thick as the fabric sleeve. In still other embodiments, the sleeve has a portion of its surface made of ballistic nylon fabric, and is sewn to a pin-slowing inner surface portion to form the remainder of the sleeve, and the pin-slowing inner surface portion is made of a plastic-coated fabric that is more than twice as thick as the fabric sleeve. In some embodiments, the structure additionally includes a pinsetting machine that with a pin-sweep mechanism configured to move pins from an end of a bowling lane alley to a Ball Pit, an Overflow Chute, wherein the Pin Sock is attached to the Overflow Chute to receive pins that pass through the Overflow Chute, a Pin Elevator configured to move pins from the Ball Pit to a raised position where at least some of the pins drop into the Overflow Chute, wherein the Pin Sock is configured to be attached to the Overflow Chute, a Transport Band configured to receive pins that drop through the Pin Sock, and a pinsetting device configured to receive pins from the Transport Band and to set the pins on a surface of the end of the lane alley.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should be, therefore, determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

What is claimed is:

1. An apparatus comprising:

an improved bowling Pin Sock having an open input end adapted to be attached to a lower end of an Overflow Chute, an open output exit, and a resilient pin-slowing inner surface portion configured to hang at a curve that is substantially vertical at its upper end and substantially non-vertical at its lower end, the pin-slowing inner surface portion having a length substantially longer than its width, and a stiffness sufficient to maintain a flattened J-Shape, wherein the lower end of the pin-slowing inner surface portion extends beyond a vertical extension of an opposite side of the sock that hangs substantially vertically from the Overflow Chute and the Pin Sock includes an outer fabric sleeve made of ballistic nylon fabric, and the pin-slowing inner surface portion is sewn to an inner surface of the fabric sleeve.

2. The apparatus of claim 1, wherein the pin-slowing inner surface portion is made of a plastic-coated fabric that is thicker than the fabric sleeve.

3. The apparatus of claim 2, wherein the pin-slowing inner surface portion is made of a plastic-coated fabric that is more than twice as thick as the fabric sleeve.

4. The apparatus of claim 1, wherein the pin-slowing inner surface portion is made of a material that is thicker than the fabric sleeve.

5. The apparatus of claim 1, wherein the Pin Sock has a portion of its surface sleeve made of ballistic nylon fabric, and is sewn to the pin-slowing inner surface portion to form the remainder of the sleeve, and the pin-slowing inner surface portion is made of a plastic-coated fabric that is more than twice as thick as the fabric sleeve.

6. The apparatus of claim 1, further comprising:

a pinsetting machine that includes:

a pin-sweep mechanism configured to move pins from an end of a bowling lane alley to a Ball Pit;

an Overflow Chute, wherein the Pin Sock is attached to the Overflow Chute to receive pins that pass through the Overflow Chute;

a Pin Elevator configured to move pins from the Ball Pit to a raised position where at least some of the pins drop into the Overflow Chute, wherein the Pin Sock is configured to be attached to the Overflow Chute;

a Transport Band configured to receive pins that drop through the Pin Sock; and a pinsetting device configured to receive pins from the Transport Band and to set the pins on a surface of the end of the lane alley.

7. The apparatus of claim 1, wherein the pin-slowing inner surface portion is a hardened insert.

8. A method comprising:

receiving a bowling pin from a lower exit orifice of an Overflow Chute;

containing the pin within a sleeve;

slowing the pin by friction of the pin rubbing against a resilient surface within the sleeve wherein the resilient surface has a stiffness sufficient to maintain a flattened J-Shape;

altering the pin's direction along a curve from substantially vertical to a direction having a horizontal component; and only releasing the pin from the sleeve to position on a Transport Band that is not under a vertical extension of the Overflow Chute's lower exit orifice, wherein the sleeve includes an outer fabric sleeve made of ballistic nylon fabric, and a pin-slowing inner surface portion is sewn to an inner surface of the outer fabric sleeve.

9. The method of claim 8, wherein the pin-slowing inner surface portion is made of a plastic-coated fabric that is thicker than the fabric sleeve.

10. The method of claim 9, wherein the pin-slowing inner surface portion is made of a plastic-coated fabric that is more than twice as thick as the fabric sleeve.

11. The method of claim 8, wherein the pin-slowing inner surface portion is made of a material that is thicker than the fabric sleeve.

12. The method of claim 8, wherein the sleeve has a portion of its surface made of ballistic nylon fabric, and is sewn to a pin-slowing inner surface portion to form the remainder of the sleeve, and the pin-slowing inner surface portion is made of a plastic-coated fabric that is more than twice as thick as the fabric sleeve.

13. The method of claim 8, further comprising:

sweeping pins from an end of a bowling lane alley to a Ball Pit;

elevating pins from the Ball Pit to a raised position;

releasing at least some of the pins into the Overflow Chute;

receiving the pins from the Overflow Chute into the sleeve;

receiving pins from the Transport Band; and setting the pins on a surface of the end of the lane alley.

14. The method of claim 8, wherein the pin-slowing inner surface portion is a hardened insert.

15. An apparatus comprising:

means for receiving a bowling pin from a lower exit orifice of an Overflow Chute, means for containing the pin;

means for slowing the pin by friction;

means for altering the pin's direction along a curve from substantially vertical to a direction having a horizontal component; and means for only releasing the pin from the sleeve to position on a Transport Band that is not under a vertical extension of the Overflow Chute's lower exit orifice, wherein means for containing and the means for slowing include a sleeve that includes an outer fabric sleeve made of ballistic nylon fabric, and a pin-slowing inner surface portion is sewn to an inner surface of the outer fabric sleeve.

16. The apparatus of claim 15, wherein means for altering the pin's direction include the pin-slowing inner surface portion that is J-shaped and is made of a plastic-coated fabric that is thicker than the fabric sleeve.

17. The apparatus of claim 16, wherein the pin-slowing inner surface portion is made of a plastic-coated fabric that is more than twice as thick as the fabric sleeve.

18. The apparatus of claim 15, wherein the sleeve has a portion of its surface made of ballistic nylon fabric, and is sewn to a pin-slowing inner surface portion to form the remainder of the sleeve, and the pin-slowing inner surface portion is made of a plastic-coated fabric that is more than twice as thick as the fabric sleeve.

19. The apparatus of claim 15, further comprising:

a pinsetting machine that includes:

a pin-sweep mechanism configured to move pins from an end of a bowling lane alley to a Ball Pit;

an Overflow Chute, wherein the Pin Sock is attached to the Overflow Chute to receive pins that pass through the Overflow Chute;

a Pin Elevator configured to move pins from the Ball Pit to a raised position where at least some of the pins drop into the Overflow Chute, wherein the Pin Sock is configured to be attached to the Overflow Chute;

a Transport Band configured to receive pins that drop through the Pin Sock; and a pinsetting device configured to receive pins from the Transport Band and to set the pins on a surface of the end of the lane alley.

20. The apparatus of claim 15, wherein pin-slowing inner surface portion is a hardened insert.

* * * * *